US010682283B2

(12) United States Patent
Evavold

(10) Patent No.: US 10,682,283 B2
(45) Date of Patent: Jun. 16, 2020

(54) WEARABLE SOAKING GARMENT

(71) Applicant: James L. Evavold, St. Louis Park, MN (US)

(72) Inventor: James L. Evavold, St. Louis Park, MN (US)

( * ) Notice: Subject to any disclaimer, the term of this patent is extended or adjusted under 35 U.S.C. 154(b) by 569 days.

(21) Appl. No.: 15/481,003

(22) Filed: Apr. 6, 2017

(65) Prior Publication Data

US 2017/0290738 A1 Oct. 12, 2017

Related U.S. Application Data

(60) Provisional application No. 62/319,591, filed on Apr. 7, 2016.

(51) Int. Cl.

| | |
|---|---|
| ***A61H 35/00*** | (2006.01) |
| ***A41D 7/00*** | (2006.01) |
| *A41F 9/02* | (2006.01) |
| *A41F 3/00* | (2006.01) |

(52) U.S. Cl.

CPC ..... *A61H 35/00* (2013.01); *A41D 7/005* (2013.01); *A41D 2400/32* (2013.01); *A41F 3/00* (2013.01); *A41F 9/025* (2013.01); *A61H 2205/085* (2013.01); *A61H 2205/087* (2013.01)

(58) Field of Classification Search

CPC ..... A61H 35/00; A61H 2205/085; A61H 2205/087; A41D 7/005; A41F 3/00; A41F 9/025

USPC ..... 607/81; 165/39, 46, 101; 2/82, 238

See application file for complete search history.

(56) References Cited

U.S. PATENT DOCUMENTS

| | | | | | |
|---|---|---|---|---|---|
| 1,636,568 | A * | 7/1927 | Kennedy | A61N 1/445 | 607/1 |
| 2,691,173 | A * | 10/1954 | Smith | A41D 7/00 | 4/661 |
| 3,743,012 | A * | 7/1973 | Laxo | A41D 13/005 | 165/101 |
| 4,353,359 | A * | 10/1982 | Milbauer | A61G 10/005 | 601/166 |
| 5,312,385 | A * | 5/1994 | Greco | A61H 35/00 | 128/DIG. 24 |
| 6,287,169 | B1 * | 9/2001 | Willms | A41B 9/001 | 2/400 |
| 6,848,121 | B1 * | 2/2005 | Halid | A61F 13/66 | 2/400 |
| 2003/0083598 | A1 * | 5/2003 | Kobayashi | A61F 5/41 | 601/70 |
| 2003/0144715 | A1 * | 7/2003 | Gomez | A41D 13/1254 | 607/108 |
| 2004/0122393 | A1 * | 6/2004 | Morman | A61F 13/4902 | 604/369 |
| 2004/0194266 | A1 * | 10/2004 | Carter | A41D 13/1236 | 26/71 |

(Continued)

FOREIGN PATENT DOCUMENTS

KR 20110131892 A * 12/2011

*Primary Examiner* — Carl H Layno
*Assistant Examiner* — Michael J Lau
(74) *Attorney, Agent, or Firm* — Greg N. Geiser; Gutwein Law

(57) ABSTRACT

A wearable soaking garment. The garment adapted to be worn by a user around their pelvic region. The garment forming a cavity for the placement of water and allowing a user to comfortably soak the pelvic region, similar to a Sitz Bath.

14 Claims, 2 Drawing Sheets

(56) References Cited

U.S. PATENT DOCUMENTS

Figure 1:
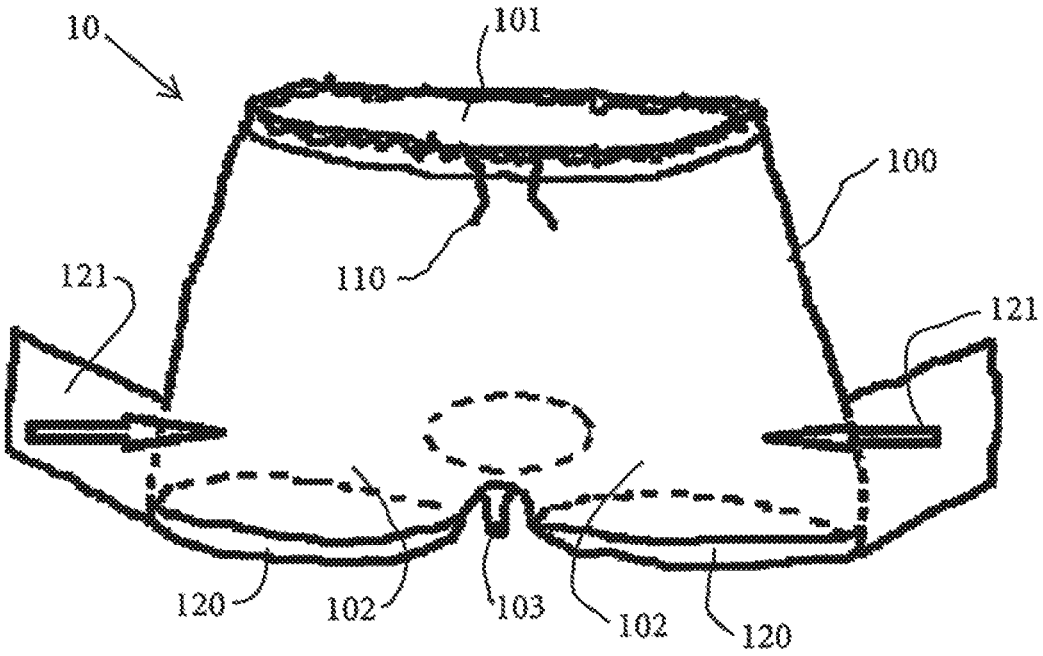

| | | | | |
|---|---|---|---|---|
| 2005/0228328 | A1* | 10/2005 | Carter | A41D 13/1236 602/44 |
| 2007/0141940 | A1* | 6/2007 | Baychar | B32B 7/08 442/328 |
| 2010/0298786 | A1* | 11/2010 | Nakamura | A61H 33/14 604/289 |
| 2011/0041839 | A1* | 2/2011 | Lee | A61F 5/0193 128/96.1 |
| 2011/0071461 | A1* | 3/2011 | Tanaka | A61M 35/00 604/24 |
| 2011/0257589 | A1* | 10/2011 | Nakamura | A61K 45/06 604/24 |
| 2011/0264021 | A1* | 10/2011 | Hettich | A61F 13/148 601/151 |
| 2012/0172788 | A1* | 7/2012 | Torok | A61H 35/00 604/24 |
| 2013/0226076 | A1* | 8/2013 | Nakamura | A61H 33/14 604/24 |
| 2014/0052080 | A1* | 2/2014 | Gibson | A61M 35/10 604/290 |
| 2015/0343190 | A1* | 12/2015 | Glassford | A61M 35/00 604/24 |
| 2016/0008206 | A1* | 1/2016 | Devanaboyina | A47C 9/002 601/136 |
| 2016/0073702 | A1* | 3/2016 | Stevenson | A41D 13/012 2/82 |

* cited by examiner

WEARABLE SOAKING GARMENT

CROSS REFERENCE TO RELATED APPLICATIONS

This application claims priority to U.S. Provisional Patent Application No. 62/319,591 filed 7 Apr. 2016 to the above named inventor, and is herein incorporated by reference in its entirety.

FEDERALLY SPONSORED RESEARCH OR DEVELOPMENT

Not Applicable

SEQUENCE LISTING, A TABLE, OR A COMPUTER PROGRAM

Not Applicable

FIELD OF THE INVENTION

The present invention relates to a garment adapted for wearing and to retain water to soak a user's lower body and more specifically the region including and surrounding the perineum.

BACKGROUND OF THE INVENTION

Various individuals suffer from a number of painful ailments that are related to irritation, pain, and overall discomfort associated with the various body parts, areas, and organs of, and adjacent to, the pelvic region of an individual. For men, these ailments may include, but not be limited to, prostatitis, benign prostatic hypertrophy (BPH), prostate cancer, epididymis pain, penis pain, scrotum pain, testicular pain, constipation, lower back pain, and hemorrhoids. For women, these ailments may include, but not be limited to, menstrual cramping, vaginal or vulvar itching, lower back pain, constipation, and hemorrhoids. One method of treating these various ailments is through a Sitz Bath.

A Sitz Bath is a type of bath used to treat these various ailments associated with the pelvic region and more specifically the larger perineal region which can be subdivided into the anal and urogenital regions of the body. In a Sitz Bath, a user immerses only these regions in warm or cold water for the therapeutic effect of moist temperature transfer for the temporary relief of pain related to the various medical conditions and ailments impacting this region of the body. Typically, a Sitz Bath is conducted in a normal bathtub, requiring a user to manipulate the water and their body so as to allow the water to only contact the treatment area to ensure increased blood flow, treatment, and pain relief. This can be a very time consuming and uncomfortable process in order to provide treatment to the specific treatment area. Additionally, a Sitz Bath can be conducted in a specifically designed device that is placed within a toilet seat. This device is not ideal as it is used in an unsanitary area, can also be uncomfortable, and does not generally contain a large enough volume to provide relief for an extended period of time.

Although there currently exist devices for a Sitz Bath, there exists a need in the market for an improved device for conducting a Sitz Bath. Preferably, this device is effective, easy to use, adaptable to various individuals and conditions, and includes additional features to allow for easy filling and draining. Preferably, the device is designed for use in a shower and configured in a wearable garment and adapted for wearing for a treatment period. Alternately, the device, due to its structural and material properties, can be utilized outside of the shower with an added fluid isolated to an internal cavity of the device with the device maintaining the other body regions of the wearer in a dry state.

SUMMARY OF THE INVENTION

The wearable soaking garment of the present invention is designed to allow a user to easily take a Sitz Bath or to provide general hydrotherapy treatment that is concentrated on the pelvic area of a user, including the perineal region, the anal region, and the urogenital regions of the user's body. The device is generally a waterproof garment that is adapted for wearing around the waist region of a wearer and extending opposite the waist region to the upper legs of wearer, similar to a pair of shorts. The leg portions of the garment are adapted for a sealed or at least partially sealed engagement at a lower portion of the garment through a gasketing means encircling the upper legs or mid-thighs of the wearer to retain placed fluids, preferably water. Accordingly, the garment, garment materials, and garment gasketing means form a watertight or semi-watertight cavity or cavities allowing a wearer to fill the garment with water facilitating a modified form of a Sitz Bath or general hydrotherapy to the pelvic region. Additionally, the device provides the wearer the ability to introduce additional components into the device to treat the fluid, these components may include, but not be limited to, minerals, salts, fragrances, herbs, essential oils, or other similar components. The device may include a drain plug placed within a lower portion of the cavity to selectively allow for the flow of water through the garment if desired and additional securing means and features to ensure proper fit and performance.

BRIEF DESCRIPTION OF THE SEVERAL VIEWS OF THE DRAWING(S)

Figure 2:
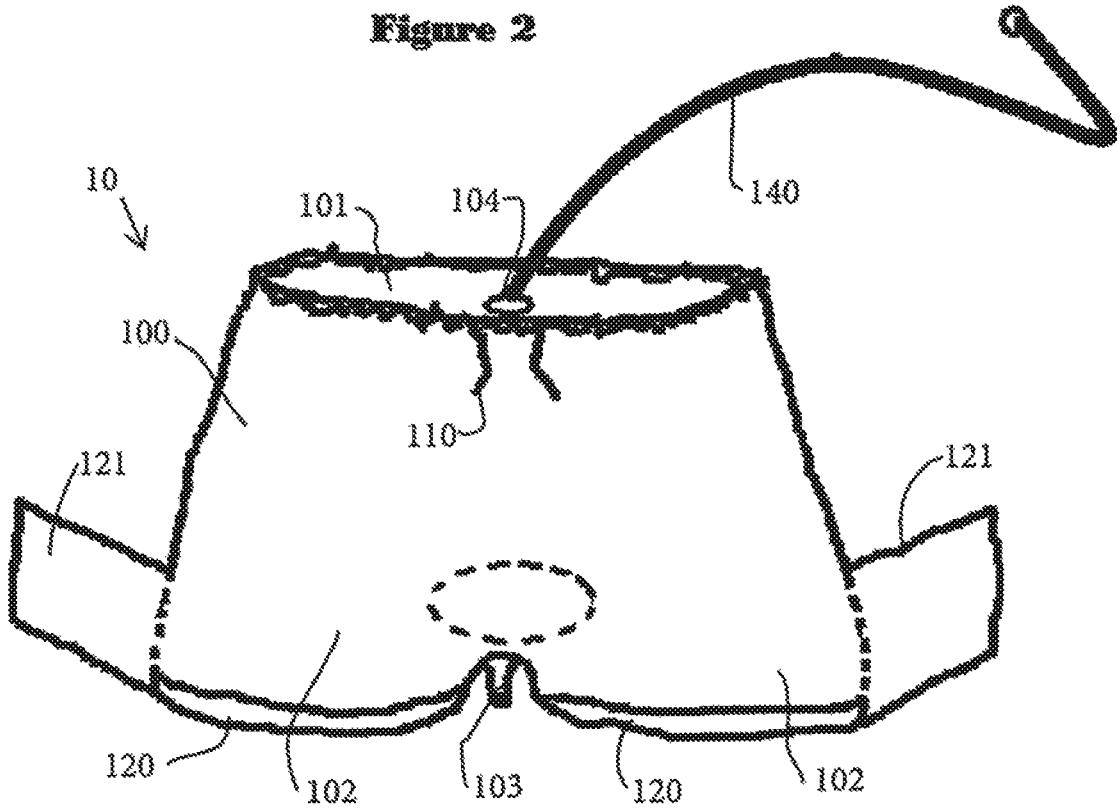

The accompanying drawings are included to provide a further understanding of the present invention and are incorporated in and constitute a part of this specification. The drawings illustrate exemplary embodiments of the present invention and together with the description serve to further explain the principles of the invention. Other aspects of the invention and the advantages of the invention will be better appreciated as they become better understood by reference to the Detailed Description when considered in conjunction with accompanying drawings, and wherein:

FIG. 1 is a front side view and description of the wearable soaking garment, according to the present invention; and FIG. 2 is a front side view and description of an optional hose attachment for the filling of the wearable soaking garment, according to the present invention.

DETAILED DESCRIPTION OF THE INVENTION

The following detailed description includes references to the accompanying drawing, which forms a part of the detailed description. The drawing shows, by way of illustration, specific embodiments in which the invention may be practiced. These embodiments, which are also referred to herein as "examples," are described in enough detail to enable those skilled in the art to practice the invention. The embodiments may be combined, other embodiments may be utilized, or structural, and logical changes may be made without departing from the scope of the present invention. The following detailed description is, therefore, not to be taken in a limiting sense.

Before the present invention is described in such detail, however, it is to be understood that this invention is not limited to particular variations set forth and may, of course, vary. Various changes may be made to the invention described and equivalents may be substituted without departing from the true spirit and scope of the invention. In addition, many modifications may be made to adapt a particular situation, material, composition of matter, process, process act(s) or step(s), to the objective(s), spirit or scope of the present invention. All such modifications are intended to be within the scope of the disclosure made herein.

Unless otherwise indicated, the words and phrases presented in this document have their ordinary meanings to one of skill in the art. Such ordinary meanings can be obtained by reference to their use in the art and by reference to general and scientific dictionaries.

References in the specification to "one embodiment" indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The following explanations of certain terms are meant to be illustrative rather than exhaustive. These terms have their ordinary meanings given by usage in the art and in addition include the following explanations.

As used herein, the term "and/or" refers to any one of the items, any combination of the items, or all of the items with which this term is associated.

As used herein, the singular forms "a," "an," and "the" include plural reference unless the context clearly dictates otherwise.

As used herein, the terms "include," "for example," "such as," and the like are used illustratively and are not intended to limit the present invention.

As used herein, the terms "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the invention.

As used herein, the term "coupled" means the joining of two members directly or indirectly to one another. Such joining may be stationary in nature or movable in nature and/or such joining may allow for the flow of fluids or other types of signals, materials, or communication between two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element without departing from the teachings of the disclosure.

Referring now to FIGS. 1-2 of the wearable soaking garment adapted to be worn by a wearer and generally referred to as garment device 10. The device 10 of the present invention is primarily designed to provide a wearable soaking cavity adapted for soaking the general pelvic area of wearer. The pelvic area within this specification is defined as the general area of the wearer's body encompassing the torso of the wearer and extending from the lower abdominal area to the upper leg area, and more particularly the upper thighs of the wearer. This pelvic area includes the perineal region, the anal region, and the urogenital region of the wearer's body.

The garment device 10 is constructed primarily from a waterproof shell 100 generally resembling a loosely fitting pair of shorts and adapted for wearing around the torso of the wearer. The waterproof shell 100 forming a continuous impermeable barrier for the securing of a fluid within an interior. The shell 100 having a waist opening 101 at an upper portion of the shell 100 adapted for placement around the waist of the wearer and a pair of leg openings 102 adapted for placement around the legs of the wearer with each leg opening of the pair of leg openings 102 adapted for securing to a leg of the wearer to hold in water or fluid.

The waist opening 101 extending loosely around the circumference of the waist of the wearer, wherein it is loosely secured and slightly enlarged relative to the wearer's standard waist size to allow for the placement of a fluid within the garment 10 shell 100. The waist opening 101 secured around the waist circumference of the user through a waist securing means 110 affixed to the garment 10 and flexible to provide for an adjustable or self-adjusting tension. Preferably, this waist securing means 110 is a drawstring tie secured within a tunnel of a waist band portion adjacent the waist opening 101 within the shell 100 for cinching by the wearer. In an alternate embodiment, the waist securing means 110 may be comprised of an elastic material to allow for flexion of the waist band waist opening 101 for easy removal and placement.

The pair of leg openings 102 of the device 10 allow the device 10 to resemble shorts with a lower portion 120 of each leg opening of the pair of leg openings 102 including a gasketing means 121 adapted to securely encircle the legs of the wearer, preferably at a mid-thigh position, and wherein the secured leg opening 102 lower portions 120 gasketing means 121 form a generally watertight seal. The gasketing means 121 adapted for placement against the body side of the wearer and comprised of a material that allows the wearer to generally tighten the lower portion 120 of the leg opening 102.

The shell 100 material properties and structural elements allow the device 10 to form a generally impermeable interior cavity around the wearer's body regions surrounded by the shell 100 to hold a volume of fluid within this cavity to soak the body parts contained within the shell 100 to provide treatment or relief.

The gasketing means 121 of the device 10 are designed to create a seal around the pair of leg openings 102 to provide a flexible tension to the openings 102 to generally seal the lower portion 120 and form the interior cavity. The shell 100 gasketing means 121 is preferably constructed out of a generally flexible material having a tapered and elastic circumference to tightly secure the leg openings 102 as the shell 100 is pulled up and onto the body of the wearer. Alternately, the gasketing means 121 can be constructed out of any number of materials and structures to generally provide the seal. These materials, including but not limited to, fabric shell material, neoprene materials with a gripping surface for hook and loop engagement, hook and loop straps and fasteners, elastic drawstrings, straps, elastic materials, body safe adhesives, and other similar gasketing materials to secure the leg openings 102 against the body side of the wearer. Preferably, this gasketing means 121 is comprised of a flexible material having an adjustable tension, wherein the wearer can adjust the tension of the gasketing means 121 to ensure a secure seal of the lower portion 120.

In the preferred embodiment of the present invention, the material of the shell 100 is comprised of, but not limited to, a Poly Urethane Laminate (PUL), Taslan Nylon based fabric, neoprene, rubber, or plastic materials for their fluid retention capabilities.

In an alternate embodiment, the shell 100 includes a drain plug 103 with corresponding stopper. The drain plug 103 positioned adjacent to the lower portion 120 and adapted to allow for the flow of fluid within the shell 100 and through the device 10. Accordingly, the device 10 is utilized in this modified form to create a hydrotherapy affect with fluid flow. Additionally, the plug 103 may be used to drain the device 10 at the conclusion of use.

In yet another alternate embodiment of the present invention, the device 10 includes connecting means 104. The connecting means 104 allowing for the connection of a hose 140, wherein the wearer of the device 10 may fill the cavity within the shell 100 though a connection of the hose 140 with a faucet.

Alternately, the device 10 waist opening 101 may be secured to the body of the wearer through suspenders (not pictured). The suspenders affixed on opposed sides and a front portion and rear portion of the shell 100, wherein the device 10 is suspended from the shoulders of the wearer to provide additional support for a filled device 10.

In use, a user will wear the device 10 by pulling the shell 100 over their legs by placing each leg into a corresponding leg opening 102 and securing the device 10 waist securing means 110 around the waist of the wearer. The wearer will then secure the gasketing means 121 of the lower portion 120 to secure the leg openings 102 around the upper legs of the wearer. The wearer may then wear the device 10 into a shower/tub to collect the shower spray within the device 10 or simply pour a fluid into the shell 100 portion where the fluid is retained for treatment of the body regions within the interior of the shell 100. Alternately, the wearer may wear the device 10 outside of the shower. The wearer will then relax standing or sitting outside the shower/tub, inside the shower/tub, or sitting on a toilet and enjoy the relief of the modified Sitz bath allowing the wearer to participate in other tasks, such as shaving, brushing teeth, and other cosmetic activities while soaking with the device on 10. Upon conclusion of the device 10 use, the wearer will open the leg opening 102 gasketing means 121, allow the fluid to drain and remove the device 10. Alternately, the wearer may utilize the drain plug 103 to empty the device 10 into the tub/shower or toilet.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) but that the invention will include all embodiments falling with the scope of the specification.

What is claimed is:

1. A garment adapted for wearing by a wearer, the garment designed to function as a fluid retaining device for the pelvic region of the wearer, the garment comprising:

a waist region, the waist region adapted to extend loosely around a waist circumference of the wearer;

a pair of leg openings, each leg opening of the pair of leg openings having an adjustable tension and adapted to be movably secured by the wearer around an upper leg portion encircling each leg of the wearer; and a securing means, the securing means coupled to the waist region and adapted to secure the device-upon the pelvic region of the wearer around the waist circumference, wherein the device is generally waterproof and forming a cavity for the placement of a fluid, the fluid retained against the body and in contact with the pelvic region through the structure of the garment.

2. A garment as in claim 1, wherein the garment includes a drain plug, the drain plug allowing for fluid flow from the garment, wherein the garment functions as a hydrotherapy device.

3. A garment as in claim 2, wherein the garment includes a hose attachment means, the hose attachment means allowing for the attachment of a hose coupled to the attachment means and a water source to fill the garment during use.

4. A garment as in claim 1, wherein the garment waist region includes suspenders.

5. A garment adapted for wearing by a wearer, the garment designed to function as a fluid retaining device for the pelvic region of the wearer enabling fluid to contact a skin surface of the wearer, the garment comprising:

a shell, the shell comprised of a waterproof material and adapted to surround the pelvic region of the wearer, the shell having an inner side, the inner side defining an interior cavity, the interior cavity adjacent and in contact with a body side of the wearer, the shell having:

a waist opening, the waist opening positioned at an upper portion of the shell, the waist opening extending loosely around a waist circumference of the wearer, the waist opening including a waist securing means, the waist securing means coupled to the waist opening and adapted to secure the device around the waist circumference of the wearer;

a pair of leg openings, each leg opening of the pair of leg openings having an adjustable gasket, each of the adjustable gaskets encircling an upper leg portion of each leg of the wearer, each of the adjustable gaskets movable by the wearer to adjust tension for forming an impermeable barrier; and wherein fluid placed within the interior cavity is retained during wearing of the garment by the wearer.

6. A garment as in claim 5, wherein the shell includes a drain plug, the drain plug allowing for fluid flow from the garment, wherein the garment functions as a hydrotherapy device.

7. A garment as in claim 6, wherein the shell includes a hose attachment means, the hose attachment means allowing for the attachment of a hose coupled to the attachment means and a water source to fill the interior cavity of the shell during use.

8. A garment as in claim 5, wherein the waist opening includes suspenders.

9. A garment as in claim 5, wherein the waist securing means is a draw string.

10. A garment as in claim 5, wherein the waist securing means is an elastic member.

11. A garment as in claim 5, wherein the gasketing means is comprised of a neoprene material.

12. A garment as in claim 5, wherein the shell is comprised of poly urethane laminate.

13. A garment as in claim 5, wherein the shell is comprised of a Taslan Nylon based fabric.

14. A method of conducting a Sitz style bath using a garment as in claim 5, the method comprising:

placing the garment on the body of a wearer;

securing the garment to the body by movably securing each of the gaskets about the upper legs of the wearer; and placing a fluid into the interior cavity of the garment.

* * * * *